United States Patent [19]

Woolworth

[11] 4,028,048

[45] June 7, 1977

[54] SCRAP METAL PREHEATING APPARATUS AND METHOD

[76] Inventor: Harrison R. Woolworth, P.O. Box 88573 Tukwila Branch,, Seattle, Wash. 98188

[22] Filed: Oct. 20, 1975

[21] Appl. No.: 623,998

Related U.S. Application Data

[63] Continuation-in-part of Ser. No. 543,114, Jan. 22, 1975, abandoned.

[52] U.S. Cl. ..... 432/5; 165/106; 432/83

[51] Int. Cl.[2] ..... F27D 7/00; F27D 17/00

[58] Field of Search ..... 432/5, 30, 82, 83; 165/106; 266/171, 175, 185, 359, 274

[56] References Cited

UNITED STATES PATENTS

| | | | |
|---|---|---|---|
| 708,018 | 9/1902 | Brown | 432/82 |
| 1,050,079 | 1/1913 | Kauffman | 266/185 |
| 1,531,695 | 3/1925 | Eustis | 266/185 X |
| 1,844,604 | 2/1932 | Schwab | 432/82 |
| 3,476,372 | 11/1969 | Tezuka | 266/33 |
| 3,521,868 | 7/1970 | Engleman | 432/5 |
| 3,669,436 | 6/1972 | Kemmetmueller | 266/33 |
| 3,795,487 | 3/1974 | Tamalet | 165/106 |
| 3,858,090 | 12/1974 | Lehmann | 165/106 X |

*Primary Examiner*—John J. Camby
*Attorney, Agent, or Firm*—Christensen, O'Connor, Garrison & Havelka

[57] ABSTRACT

A metal preheating apparatus has a box-like structure including, a bottom, a top wall, a pair of sidewalls, and a pair of end walls forming an enclosed receptacle. Fluid channels are defined between the outer surfaces of a pair of inner walls spaced inwardly from the sidewalls and the inner surfaces of the sidewalls. The upper and lower edges of the inner walls terminate short of the top wall and short of the bottom to place the upper portion of the receptacle in fluid communication through the fluid channel with the lower portion of the receptacle. A horizontally, oriented, load supporting grate member is positioned intermediate these apertures and extends longitudinally between the end walls and transversely between the inner walls. The bottom of the structure is open. The top wall of the structure contains an upper door for charging scrap metal into the upper portion of the receptacle so that the scrap metal is supported by the grate member. An end door is provided in one of the end walls to discharge the scrap metal from the upper portion of the receptacle. In operation, scrap metal is charged into the upper portion and the upper door is closed. The entire apparatus is then positioned over hot metal ingots that have just been removed from their molds. The heated air surrounding the ingots rises through the scrap metal. As the air passes upwardly by convection through the scrap metal, heat is transferred from the air to the scrap metal, cooling the air and heating the scrap metal. The cooled air enters the fluid channels from the upper portion of the receptacle, travels downwardly by convection through the fluid channels, and exits from the fluid channels into the lower portion of the receptacle. The air then passes by the ingots and is reheated to begin another convection cycle for preheating the scrap metal.

12 Claims, 8 Drawing Figures

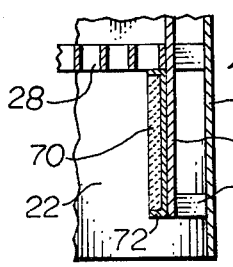
Fig. 5.
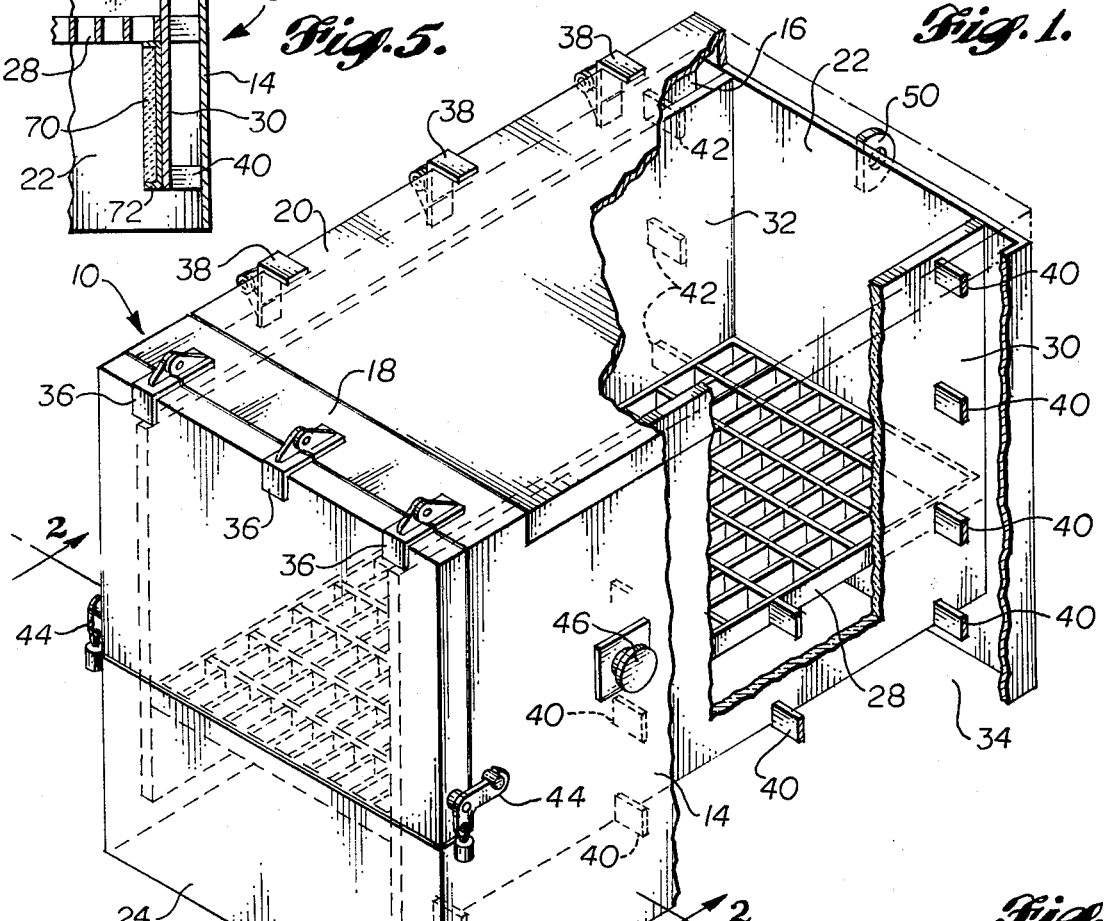
Fig. 1.
Fig. 3.
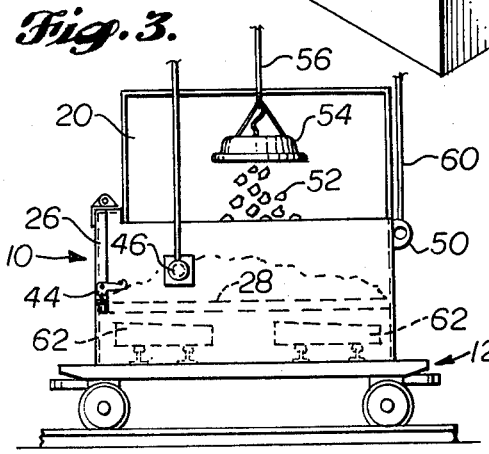
Fig. 2.
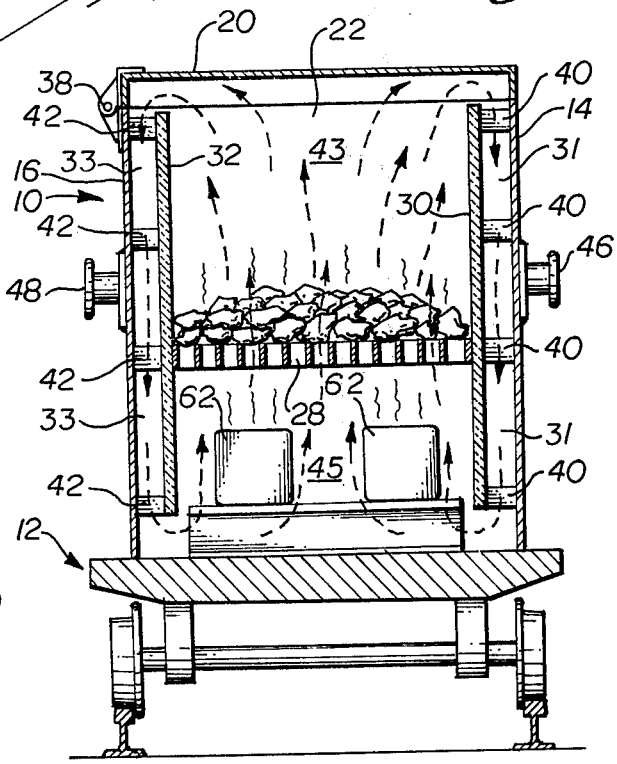
Fig. 4.
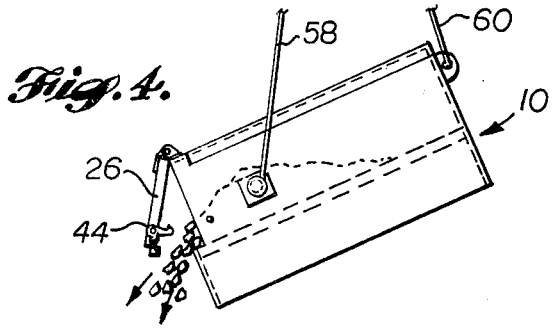

SCRAP METAL PREHEATING APPARATUS AND METHOD

BACKGROUND OF THE INVENTION

This application is a continuing in part application based on prior copending application, Ser. No. 543,114, filed Jan. 22, 1975, now abandoned, the benefit of the filing date of which is hereby claimed under 35 U.S.C. 120.

The present invention relates to an apparatus and method for heating scrap metal, and more particularly, to an apparatus and method for preheating scrap metal prior to charging the scrap metal into a melting furnace using the heat stored in metal ingots just removed from a mold.

In the iron and steel recycling industry, scrap metal is gathered and charged into a melting furnace, melted, removed from the furnace in molten form, and poured into molds. As soon as the molten steel has solidified into ingots, the ingots are removed from the mold and transported to rolling mills or other secondary processing locations. Normally, the scrap metal is at ambient temperatures when charged into the melting furnace, requiring the metal to be heated from the ambient temperature to melting temperatures that are on the order of 2800° F. to 3000° F. (on the order of 1500° C. to 1600° C.). When the ingots are removed from the molds after solidifying, their temperature is still normally on the order of 1000° C. This heat is normally wasted since the ingots are normally allowed to cool substantially below that temperature or to ambient temperature before being subjected to further processing. Thus, a substantial amount of heat energy is wasted to the atmosphere when the ingots are allowed to cool.

It has been recognized that the heat energy stored in the ingots can be utilized to preheat scrap metal prior to charging into a melting furnace. Several means for preheating the scrap metal from the ingots have been suggested. One apparatus for preheating scrap metal with ingots is disclosed in U.S. Pat. No. 3,521,868, issued to Joseph H. Engleman. The Engleman device comprises a box-like structure into which the hot ingots are placed after removal from their molds. Scrap metal is then deposited on the ingots to fill the enclosure. A fan is used to circulate air through the container to assist in transferring heat from the ingots to the scrap metal. Although this device operates satisfactorily, it has several disadvantages. If high purity ingots are being produced, there is the possibility that they will be contaminated by impurities from the scrap metal since there is intimate contact between the scrap metal and the ingots. The Engleman device also requires a separate processing step, in turn requiring a special processing area that must be added to the present ingot processing area. Moreover, the Engleman device constitutes a completely separate apparatus that cannot be employed for other functions in steel processing. Also, since the ingots are placed in the Engleman structure prior to charging with scrap metal, a means for handling the ingots, such as a hook molded into the ingot, must be provided. In addition, since the ingots are covered by scrap metal in the Engleman device, it is difficult to separate the scrap metal from the ingots after the scrap metal is preheated. Separation of the scrap metal is particularly a problem since electromagnetic handling equipment commonly used in transferring ferrous metals is nonselective, attracting all ferrous metals within the magnetic flux field. Finally, the fan employed with the Engleman device requires additional energy input to conserve the heat energy stored in the ingots.

Accordingly, it is a broad object of the present invention to provide a simple, efficient method and an equally simple, inexpensive apparatus for preheating scrap metal prior to charging it into a melting furnace with heat derived from hot, recently solidified metal ingots. Specific objects within the scope of the foregoing broad object of the invention are to provide a method and apparatus for preheating scrap metal that will substantially eliminate ingot contamination from impurities in the scrap metal; that will not necessarily require a totally separate apparatus or processing step from apparatus and processing steps employed in conventional ingot and scrap metal handling; that can be integrated into present materials handling and furnace operation methods; that require no special handling technique for the ingots; that require no additional energy input to utilize the latent heat present in the ingots; that can utilize the energy sources present in scrap metal in the form of combustible materials; that present little or no problem in separating the scrap metal from the ingots after the scrap metal has been preheated; and that can be employed in an efficient, economically attractive, and simple manner.

SUMMARY OF THE INVENTION

In accordance with the foregoing objects, and other objects that will become apparent to one of ordinary skill in the art upon reading the following specification, the present invention broadly provides a method for preheating scrap metal with hot metal ingots. The method comprises three essential steps and a fourth preferred step. First, the heated metal ingot is positioned on a platform and a charge of scrap metal is supported or positioned above the ingot so that the charge of scrap metal is in fluid communication with the region surrounding the ingot. The charge of scrap metal and the ingot are enclosed to form a substantially fluid tight chamber whereby air in the chamber can circulate past the ingots and through the charge of scrap metal to heat the scrap metal. As the air passes through the scrap metal charge, it transfers heat to the charge, cooling the air. The cooled air returns from the region adjacent the top of the charge to the region below and surrounding the ingot via convection through a fluid channel that is separate from the region enclosing the ingot and scrap metal charge. The method can further comprise placing waste combustible material in the chamber, raising the combustible material to its kindling temperature, and heating the scrap with the heat produced by the combustion of such material.

The apparatus for preheating a material with a heated object as provided by this invention comprises a housing means defining a receptacle, a load supporting member in the housing means, and a conduit means defining a fluid channel within the housing means. The load supporting member is positioned within the housing means so as to divide the receptacle into a closed upper portion and a lower portion. The load supporting member has apertures therein that place the lower portion of the receptacle in fluid communication with the upper portion of the receptacle so that heated air can travel upwardly from a heated object housed in the lower portion of the receptacle. The conduit means has an inlet positioned adjacent the top wall of the receptacle placing the fluid channel in fluid communication with the upper portion of the receptacle and an outlet positioned in the lower portion of the receptacle placing the fluid channel in fluid communication with the lower portion of the receptacle. A door means is associated with the housing means to allow access to the upper portion of the receptacle for charging the upper portion of the receptacle with a material to be heated and for discharging a heated material from the upper portion of the receptacle. Means is also associated with the housing means to provide access to the lower portion of the receptacle for positioning a heated object therein. In one embodiment the latter means is provided by an opening in the bottom of the housing means.

BRIEF DESCRIPTION OF THE DRAWINGS

A better understanding of the present invention can be derived by reading the ensuing specification in conjunction with the accompanying drawings wherein:

FIG. 1 is a partially cutaway isometric view of a preferred embodiment of the apparatus of the present invention;

FIG. 2 is a cross-sectional view of the apparatus shown in FIG. 1 as supported by a rail car platform holding a plurality of heated metal ingots;

FIG. 3 is a simplified side elevation view of the apparatus illustrated in FIG. 2 with the charging door open and scrap metal being charged into the upper portion of the apparatus;

FIG. 4 is a simplified view showing preheated scrap metal being emptied from the apparatus into a furnace;

FIG. 5 is a cross-sectional view of a portion of one side of an apparatus similar to that shown in FIG. 2 illustrating the location of optional insulation on the lower portion of the inner wall;

DESCRIPTION OF PREFERRED EMBODIMENTS

Figure 8:
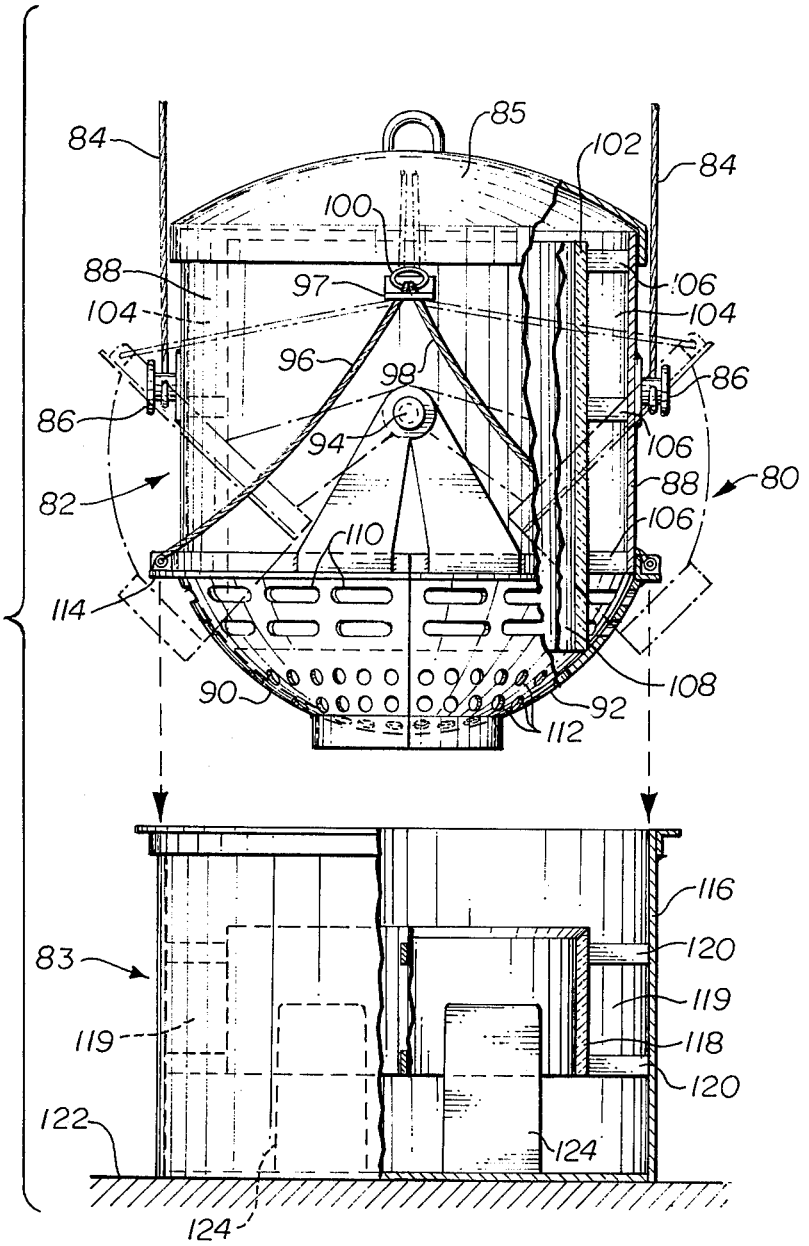

Referring first to FIG. 1 and the portion of FIG. 2 showing the preheating apparatus 10 in operation resting on a flatbed rail car 12, the apparatus includes two sidewalls 14 and 16, a top wall 18 incorporating a top door 20, two end walls 22 and 24, one of which incorporates an end door 26, a scrap metal supporting grate 28 located between the top and bottom of the apparatus, and a pair of inner walls 30 and 32. The sidewalls 14 and 16, arranged in a generally upright orientation, are parallel to and spaced from each other. The end walls 22 and 24, also arranged in a generally upright orientation, are parallel to each other, are spaced from each other by the longitudinal dimension of the apparatus 10, and are generally oriented at right angles to and affixed to the sidewalls 14 and 16. One end wall 22 extends upwardly from the bottom of the apparatus to the full height of the sidewalls 14 and 16. The top wall 18 extends transversely across the apparatus and is affixed to the upper edges of the sidewalls 14 and 16 adjacent the other end wall 24 containing the end door 26. The longitudinal dimension of the top wall is small relative to the longitudinal dimension of the apparatus to accommodate the top door 20 as explained below. The end wall 24 extends upwardly from the bottom of the apparatus 10 to a location adjacent the grate 28.

The end door 26 extends upwardly from the upper edge of the end wall 24 to the full height of the apparatus. The end door 26 extends transversely to the sidewalls 14 and 16 and has side flanges that extend longitudinally a short distance into notches provided in the sidewalls 14 and 16 and the top wall 18. Suitable hinges 36 mutually affixed to the top wall 18 and to the upper end of the end door 26 mount the door for swinging movement to provide access from the end of the apparatus to the upper portion of the interior of the apparatus 10 above the grate 28. As the end door 26 swings about the hinges 36 the bottom portion of the door swings outwardly and upwardly away from the end of the apparatus.

The upper door 20 extends from the transversely terminating edge of the upper wall 18 longitudinally across the top of the apparatus 10 and terminates above the end wall 22 opposite from the end door 26. The upper door 20 extends across the entire transverse dimension of the apparatus and terminates above the sidewalls. Flanges are affixed to the edges of door 20 and extend a small distance downwardly into notches provided in the sidewalls 14 and 16 and the end wall 22. The flanges on both the end door 26 and the top door 20 provide structural rigidity to the doors. These flanges can be omitted and other rigidifying structural members can be mounted on the doors as desired. The upper door 20 is mounted for swinging movement by hinges 38 attached to one sidewall 16 and the adjacent longitudinally extending edge of the door 20. The hinges mount the door for swinging movement so that the edge of the door opposite the longitudinally extending hinged edge can swing upwardly and sidewardly relative to the apparatus to provide access to the interior of the apparatus 10 from the top.

The inner walls 30 and 32 extend longitudinally between the end wall 22 and the end wall 24 and end door 26. The vertically extending end edges of the inner walls 30 and 32 are secured to the inner surfaces of the end walls 22 and 24. The inner wall 30 is spaced inwardly from the sidewall 14 by a distance sufficient to form a fluid channel 31 between the inner surface of the sidewall 14 and the outer surface of the inner wall 30. suitable spacers 40 are secured between the outer surface of the inner wall and the inner surface of the outer wall to maintain the separation between the inner wall 30 and the sidewall 14. Likewise the inner wall 32 is spaced inwardly from the sidewall 16 so as to form a second fluid channel 33 between the inner surface of the sidewall 16 and the outer surface of the inner wall 32. Again suitable spacers 42 are provided to maintain the separation between the walls 16 and 32.

The grate 28 in this embodiment is a composite unit comprised of a network of transversely spaced, longitudinally extending bars intersected by a plurality of transversely extending, longitudinally spaced bars. The grate may rest of its own weight on supports affixed to the inside faces of the inner walls 30 and 32, though preferably, is permanently affixed to the inner walls to prevent displacement during loading or unloading of the apparatus. The grate 28 forms an apertured support structure for scrap metal as will be described in further detail later. The apparatus 10 thus forms a housing or receptacle that is divided by the grate member 28 into an upper portion 43 and a lower portion 45. The upper portion 43 is bounded by the upper portions of the inner walls 30 and 32, the end wall 22, the end door 26, the top wall 18, and the top door 20 thereby forming a receptacle for material to be preheated. The lower portion 45 is bounded by the lower portions of the inner walls 30 and 32, the lower portion of end walls 22 and 24.

The lower interior portion of the housing is in fluid communication with the upper portion of the housing through the grate member 28. In addition, the upper, longitudinally extending edges of the inner walls 30 and 32 terminate below the lower surface of the top wall 18 and the lower surface of the door 20 to form apertures. These apertures place the fluid channels 31 and 33 formed between the inner walls 30 and 32 and the sidewalls 14 and 16 in fluid communication with the upper interior portion 43 of the housing. Likewise the bottom or longitudinal edges of the inner walls terminate above the bottom of the appartus 10 forming apertures that place the bottom portion 45 of the housing in fluid communication with the bottom portion of the fluid channels 31 and 33 formed between the inner and sidewalls.

Suitable counterweighted latches are affixed to the end wall 24 and the bottom of the end door 26. When the end of the apparatus opposite the end door is elevated relative to the end door, the latches 44 will release, allowing the door to swing about its hinges 36. Lift pins 46 and 48 extend transversely outwardly from the sidewalls 14 and 16 in mutually opposite directions. The lift pins 46 and 48 are provided for connection to a suitable overhead crane for lifting the apparatus 10. Likewise a flange 50 extends longitudinally outwardly from the end wall 22 opposite the end door 26. The flange is provided with an aperture serving as a third connection point for cables running to an overhead crane. In this manner by lifting an equal distance on the lift pins 46 and 48 and the flange 50 the device can be elevated and be transported to any desired location by an overhead crane. When the flange 50 is lifted upwardly relative to the lift pins 46 and 48, the entire apparatus 10 will be slanted downwardly in the direction of the end door 26. When the latch 44 is unlocked and the apparatus is tilted as just described, scrap metal residing on the grate 28 can be emptied through the door 26 (as illustrated in FIG. 4).

In operation, scrap metal is charged into the upper portion of the apparatus 10 by first securing the end door 26 via latches 44 and then swinging the top door 20 open as shown in FIG. 3. Scrap metal, schematically designated 52, is then transported by suitable means such as an electromagnetic device 54 hung from an overhead cable 56, over the opening formed by displacement of the door 20. Operating current to the electromagnetic device is then interrupted, depositing the scrap metal in the upper portion 43 of the apparatus 10. When the upper portion of the apparatus is fully charged with scrap metal 52, the upper door 20 is closed. Thereafter the apparatus 10 is lifted via suitable cables 58 and 60 secured respectively to the lift pins 46 and 48 and the end flange 50.

The apparatus, carrying a charge of scrap metal, is then transported over the location of a flatbed rail car, generally designated 12, upon which rests several hot, recently solidified ingots 62 just removed from their molds. The terms billet and ingots are used interchangeably herein to mean any hot metal mass that has been formed from molten metal and is being cooled for further processing. Recently formed ingots such as these are commonly placed on a suitable transportation device such as a rail car for cooling, thereby providing a platform for use with the apparatus 10. The distance between the bottom of the apparatus 10 and the grate 28 is sized such that, when the apparatus is lowered onto the platform over the ingots, the ingots are centrally disposed within the lower portion 45 of the housing formed within apparatus 10.

Thus the apparatus 10 and the upper surface of the platform on the rail car 12 form an enclosed, substantially fluid tight chamber housing both the scrap metal 52 and the ingots 62 as shown in transverse section in FIG. 2. Air is necessarily trapped within the enclosure formed by the apparatus 10 and the upper surface of platform, thereby providing a fluid medium for heat transfer. Heat from the ingots is immediately transferred to the air trapped within the lower portion of the receptacle, causing the air to rise through the grate 28 by natural convection. The air continues to rise through the scrap metal 52 residing on the grate 28 and continues its upward course until it reaches the region adjacent the top of the upper portion 43 of the housing. As the air traverses through the scrap metal 52, heat is transferred from the air to the scrap metal, consequently cooling the air to a lower temperature. The cooler air is then forced into the fluid channels 31 and 33 formed between the respective inner walls 30 and 32 and sidewalls 14 and 16. The relatively cool air then travels downwardly and re-enters the lower portion 45 of the housing to be reheated by the hot ingots to again traverse its natural convection path. This natural convection cycle continues to occur as long as there is a temperature differential between the scrap metal 52 and the ingot 62 residing in the lower portion of the housing to provide a driving force for the natural convection of the air. When the temperature differential between the scrap metal and the ingots becomes small, the apparatus 10 is lifted via cables 58 and 60 and positioned over the location of a suitable melting furnace (not shown) schematically in FIG 4. The end of the apparatus 10 opposite the end door 26 is then elevated relative to the door end by suitable manipulation of the lifting cables 58 and 60. As the apparatus is tilted, the latches 44 open and the end door 26 swings open, allowing the scrap metal 52 within the housing to slide downwardly along the grate 28, out of the opening formed by open door 26, and into a melting furnace 64.

In the manner just described, scrap metal is preheated by heat derived from hot metal ingots. As the heat derived from the ingots would otherwise be lost to the atmosphere, a substantial amount of energy is saved. Likewise, the energy needed to heat the scrap metal to a melting temperature in the furnace is less, thereby reducing the energy input required to operate the furnace. The apparatus 10 is designated so that it can be utilized in conjunction with the normal processing steps and with the materials handling equipment conventionally employed in the metal recycling industry. For example, the flatbed rail cars or similar transporting devices normally used can double as a platform for the preheating apparatus. The apparatus 10 further serves the dual function of a preheating device and a charging bucket for the melting furnace. Thus, the apparatus can be substituted for conventional furnace charging buckets, while functioning as a means to conserve a considerable amount of energy and effect a cost saving in the production of recycled steel. Moreover, the apparatus 10 of the present invention utilizes no additional energy input other than the power needed to transport the apparatus from one location to another. Furthermore, the apparatus has no moving parts except for the end door 26 and the upper door 20. Thus the device is relatively simple and inexpensive to construct and maintain.

If desired, ceramic insulation can be employed with the apparatus just described to insulate the fluid convection channels formed between the inner and outer walls from radiant heat transfer from the metal ingots. As shown in FIG. 5, the sidewall 14, inner wall 30 and grate 28 of the apparatus 10 are constructed identically to that previously described. A layer of ceramic insulating material 70, or other refractory composition, is posi.ioned along the entire inner surface of the inner wall 30. The insulating material is suitably secured in and supported by a metal pan 72, manufactured from stainless steel or other suitable material, which is secured in a conventional manner to the inner wall 30. Although only a segment of one inner wall is shown, it is to be understood that insulating material can be similarly located on the lower portions of both the inner walls and both of the end walls.

Although not depicted, it is also to be understood that a fluid convection channel can be provided, if necessary or desired, on one or both of the end walls of the apparatus 10. Such fluid convection channels can be constructed by positioning suitable inner end walls at inwardly spaced locations from the end walls of the apparatus.

In addition to the foregoing method and apparatus, it has been surprisingly and unexpectedly found that the use of turnings, normally readily available in a scrap yard, will result in a dramatic and substantial increase in temperature of the scrap. Turnings, as used herein, are those pieces of scrap metal that are produced in machining processes such as drill work and lathe work. These turnings are relatively bulky, i.e. have a relatively low bulk density as they are usually in the form of chips or spirally shaped particles of varying sizes. During the machining processes, oils and other combustible materials are normally used to reduce the working temperature of the workpiece and tools. These oils and other materials form a combustible, residual coating on the turnings. The combustible materials are normally not reclaimed, but are discarded with the turnings. It has been found that placement of a relatively small amount of turnings, or other scrap metal having a combustible coating, in the scrap charge of the preheater of the present invention will result in a dramatic temperature rise of the scrap at no additional cost to the user of the present invention. This dramatic rise in temperature, on the order of 400° F. to 600° F. over the temperature of the scrap heated for the same period of time without the turnings, is caused by the heat energy released from the combustion of the residual coating on the turnings.

Preferably, an amount of turnings, or other scrap metal having a combustible coating, relative to the total amount of charge in the preheating chamber on the order of less than 10 precent by weight and preferably from 3 percent to 5 percent by weight of the charge will produce the dramatic temperature increase. Moreover, the mass and temperature of the billets, in relation to the mass of the scrap metal charge and the mass of the container, must be sufficiently large to raise the temperature of the combustible material to its kindling temperature. One of ordinary skill in the art will be able to readily ascertain the requisite temperature and billet mass to accomplish this end.

EXAMPLES

The following examples were conducted to show the efficiency of the present invention using a prototype scrap preheating apparatus constructed in accordance with the invention disclosed above. These examples are intended to be representative and not delimiting in any manner.

The prototype apparatus was constructed in three parts including an inner container, an outer container having a lid, and support blocks for holding the metal billets and the inner container above the ground. The inner container was shaped in the form of a right rectangular parallelepiped having four substantially vertical walls constructed from steel plate, an open top and an open bottom. The height of the side walls was 75 inches. The length and width dimensions of the inner container were 72 inches and 36 inches, respectively. A shelf composed of expanded metal was horizontally disposed within the four walls of the inner container and was affixed to all four walls. The metal shelf was located 33 inches from the top of the container and 42 inches from the bottom of the container. This shelf supported scrap metal during the tests outlined below. The portion of the inner container below the shelf was lined with a 1 inch thick layer of ceramic fiber insulation, having a density of 8 pounds per cubic foot, to reduce heat radiation through the sides of the container.

The outer container was constructed in the shape of a right rectangular parallelepiped having four sidewalls constructed from steel plate with a height of about 85 inches, a length of about 84 inches, and a width of about 48 inches. The walls of the outer unit were insulated on the inside with a 1 inch layer of ceramic wool insulation having a density of 8 pounds per cubic foot. A lid for the outer container was constructed from one half inch steel plate insulated on the outside top portion thereof with a 1 inch thick layer of ceramic fiber insulation having a density of 8 pounds per cubic foot. The lid formed a metal to metal seal with the top edge of the outer container in Example I below. During the test of Example I, heat warpage of the lid was experienced so an additional 1 inch thick layer of ceramic fiber insulation having a density of 8 pounds per cubic foot was placed on the inside of the lid.

The billet support members comprised two spaced, parallel 5 inch square tubes layed on the ground. Eight billets having dimensions of 5 inches by 5 inches by 51 inches, and weighing 350 pounds each, were placed on top of the support tubes and oriented transversely thereto. During the tests the inner container was positioned over the billets with the bottom edge of the inner container resting on the support tubes thereby leaving a space of approximately 5 inches between the bottom edge of the container and the ground. The outer container was positioned around the inner container leaving a channel having a width of about 4 ½ inches between the layer of insulation on the inner side of the outer container and the outer surface of the side walls of the inner container. When the lid was positioned on the top edge of the outer container, a space of approximately 5 inches remained between the top edge of the inner container and the bottom surface of the lid in tests subsequent to Example I and a space of about 6 inches between the top edge of the inner container and the bottom surface of the lid during Example I.

EXAMPLE I

This example was carried out with the foregoing prototype test unit wherein the exterior of the unit was exposed to ambient outside air at a temperature of 78° F. The test unit weight exposed to the heated air was 1,580 pounds. The total weight of scrap material placed in the upper portion of the inner container was 3,000 pounds, comprised of 2,700 pounds of relatively clean, shredded scrap steel and iron and about 300 pounds of steel turnings that were heavily coated with oil, floor sweepings and similar combustible materials. Eight billets, measuring 5 inches by 5 inches by 51 inches, weighing 350 pounds each and totaling 2,800 pounds, were positioned in the lower portion of the inner container on the 5 inch support bars. The temperature of the scrap was measured at two locations by positioning a first thermocouple, securely attached by a nut and bolt to a three quarter inch by 7 inch by 12 inch steel plate, as close to the middle of the scrap positioned in the inner container as possible and a second thermocouple lead, bolted to a 3 inch steel channel about 24 inches long, on the top of the scrap near the center of the interior container. The thermocouple leads were electrically connected to a dial indicator that read out the temperatures indicated by the thermocouples on the Fahrenheit scale. The temperatures indicated by the top thermocouple and by the middle thermocouple with accompanying comment are indicated in Table I below.

The eight billets were placed on a cooling table within 19 minutes after the ladel from which the billets were cast was opened. Twenty-five minutes thereafter the inner container was placed over the billets, positioning the scrap metal above the billets. Within 15 minutes thereafter the exterior container was positioned over the interior container and covered with the lid. At that time the indicated temperature at the top of the scrap was 60° and the temperature at the middle of the scrap was 25°. The dial temperature indicator was set to read 0° at ambient temperature. Therefore the actual temperature is equal to the indicated temperature plus the ambient temperature.

TABLE I

| Lapsed Time (minutes) | Temp. at the top (° F.) | Temp. at the middle (° F.) |
|---|---|---|
| 0 | 60 | 25 |
| 11 | 60 | 25 |
| 29 | 95 | 60 |
| 49 | 150 | 150 |
| 54 | 175 | 175 |
| 60 | 195 | 200 |
| 65 | 205 | 210 |
| 70 | 210 | 235 |
| 75 | 220 | 255 |
| 80 | 255 | 300 |
| 88 | 275 | 340 |
| 94 | 290 | 355 |
| 99 | 310 | 390 |
| 104 | 325 | 415 |
| 109 | 350 | 450 |
| 114 | 370 | 480 |
| 120 | 400 | 505 |
| 128 | 500 | 605 |
| 149 | 625 | 705 |
| 164 | 810 | 750 |

TABLE I-continued

| Lapsed Time (minutes) | Temp. at the top (° F.) | Temp. at the middle (° F.) |
|---|---|---|
| 169 | 870 | 780 |
| 175 | 900 | 785 |
| 180 | 925 | 800 |

EXAMPLE II

The test procedure of Example I was repeated with the prototype unit. The upper portion of the interior container was filled with scrap weighing 2,580 pounds, no turnings were used. This test was conducted in the same manner as Example I with the following exceptions: (1) A 1 inch layer of ceramic fiber insulation having a density of 8 pounds per cubic foot was placed on the inside surface of the lid; (2) Seven instead of eight billets were placed on the support bars. The billets were separated by 1 inch to allow air to circulate around all surface areas of the billets. The ambient air temperature was 76° F. The test began approximately 45 minutes after the ladle from which the billets were cast was opened. In this test one thermocouple lead was attached to a short section of steel channel positioned on the top central portion of the scrap in the upper portion of the interior container. The second lead was placed on the top of the billets to record the cooling rate of the billets. The results of that test are set forth in Table II.

TABLE II

| Lapsed Time (minutes) | Temp. of Billet (° F.) | Temp. at top of Scrap (° F.) | |
|---|---|---|---|
| 0 | 800 | 75 | |
| 18 | 950 | 95 | |
| 23 | 950 | 105 | |
| 31 | 950 | 150 | |
| 41 | 930 | 180 | |
| 47 | 920 | 205 | *1 hr. |
| 63 | 885 | 260 | |
| 73 | 825 | 325 | |
| 83 | 800 | 335 | |
| 93 | 790 | 375 | |
| 98 | 775 | 400 | |
| 113 | 750 | 425 | *2 hr. |
| 128 | 720 | 440 | |
| 143 | 700 | 450 | |

EXAMPLE III

In this example the test procedure of Example I was repeated. The scrap charge consisted of approximately 2,500 pounds of shredded scrap steel and iron and 150 pounds of turnings similar to those used in Example I. The turnings were spread over the top surface of the scrap after it was deposited in the upper portion of the inner container. Seven billets rather than eight were positioned on the support bars. The thermocouple leads were placed as described in Example II. The test was begun approximately 40 minutes after the ladle from which the billets were cast was opened. The results of this test are set forth in Table III.

TABLE III

| Lapsed Time (minutes) | Temp. of Billet (° F.) | Temp. at top of Scrap (° F.) |
|---|---|---|
| 0 | 800 | 25 |
| 15 | 790 | 70 |
| 30 | 750 | 100 |
| 45 | 715 | 125 |
| 55 | 675 | 160 |
| 75 | 625 | 210 |

TABLE III-continued

| Lapsed Time (minutes) | Temp. of Billet (° F.) | Temp. at top of Scrap (° F.) |
|---|---|---|
| 90 | 600 | 240 |
| 105 | 550 | 275 |
| 155 | 500 | 550 |
| 165 | 500 | 600 |
| 180 | 500 | 675 |
| 190 | 500 | 700 |
| 200 | 500 | 950 |
| 210 | | 1450 |

From the foregoing examples, it can be seen that a charge containing from 3 to 5 weight percent of turnings will result in a final scrap temperature exceeding 1,000° F. This result occurs because the kindling point of the oil coating on the turnings is reached causing it to burn and in turn releasing heat energy. Without the turnings, the scrap temperature reaches approximately 600° F. The test results according to the foregoing examples can be improved by positioning the billets closer to the scrap. Additional insulation on the inner surface of the lid will also reduce heat loss through the top of the outer container. Moreover, when turnings are used, they should be placed nearer to the bottom of the scrap charge so that the heat released when the oil and other materials thereon kindle will be immediately transferred to the scrap charge. An average preheating cycle in accordance with the foregoing examples and description will raise the temperature of the scrap to an average of 600° F. by the use of energy from the cooling billets, and, if desired, to an average temperature of 1000° F. by using the combustible coating on the turnings that would otherwise be wasted. When an electrical heating furnace is used for melting of the scrap, preheating the scrap in accordance with the present invention can result in an average energy savings on the order of 20%. The actual savings will vary in accordance with the cost of electrical energy in a given locale.

Figure 6:
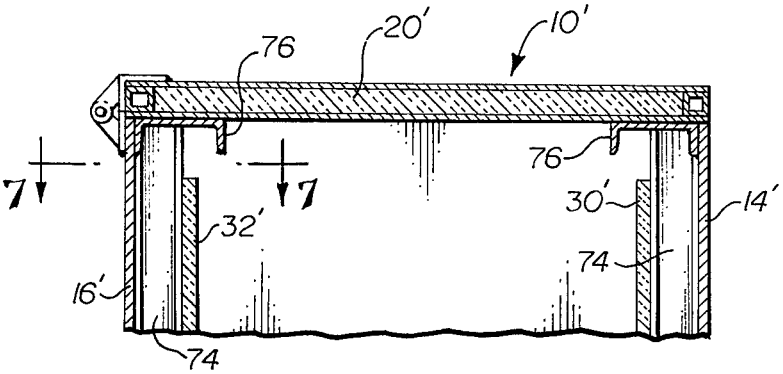
FIG. 6 is a cross-sectional view of the upper portion of an alternate embodiment of the preheating apparatus employing vertical dividers between the inner and outer walls and having a protective cover over the fluid channels formed between the inner and outer walls.
Figure 7:
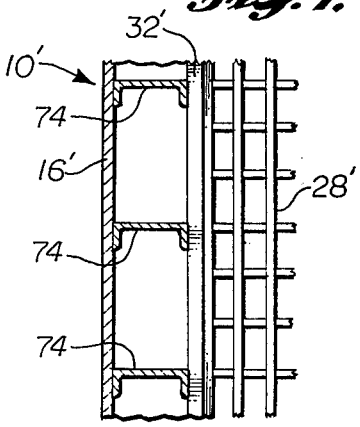
FIG. 7 is an enlarged longitudinal sectional view taken along section line 7—7 of FIG. 6 of a segment of the inner and outer walls of the alternate embodiment of the preheating apparatus; and, FIG. 8 is a side elevation view, shown partially cut away, of an alternate embodiment of the apparatus of the present invention.

Referring now to FIGS. 6 and 7, an alternate embodiment of a preheating apparatus 10' is illustrated. The same general construction and orientation of the sidewalls 14' and 16', the inner walls 30' and 32', the end wall 22' and the upper door 20' are employed. Likewise, a similarly constructed end door (not shown) can be used. In this embodiment, vertical stringers in the form of U-shaped channels 74 are employed to maintain the spacing between the inner walls and the sidewalls. The channels are vertically oriented, extending from the top to the bottom of the apparatus, and are suitably spaced in the longitudinal dimension of the apparatus to provide the requisite spacing of the walls and to provide structural ridigity to the apparatus.

In addition, inverted, U-shaped channels 76 are positioned over the fluid channels formed between the inner and outer walls to serve as a guard to prevent scrap metal from entering the convection channels when the door is open and scrap metal is being charged into the apparatus. The inverted channels 76 are chosen so that the transverse dimension of the channel web is greater than the transverse width of the fluid channels. The inverted channels are horizontally oriented and extend along the interior of the apparatus to cover the upward openings of the fluid channels. One of the downwardly extending arms or flanges of the inverted channels is secured to the inner surface of the sidewalls adjacent the top of the sidewalls. The opposite downwardly extending arms or flanges of the inverted channels are positioned at an inwardly spaced location from the inner walls. The upper, longitudinally extending edges of the inner walls are spaced below the location of the inverted channels so that apertures are formed to place the fluid channels in fluid communication with the upper portion of the housing formed within the apparatus 10'. The inverted channels 76 serve to prevent scrap metal from entering and becoming lodged in the fluid channels during charging of the apparatus. In other apsects, the apparatus 10' is constructed and used similarly to the apparatus 10 previously described.

An alternate embodiment of the invention is illustrated in FIG. 8. In this embodiment of the invention the apparatus 80 is divided into an upper charging bucket section 82 and a lower section 83. The upper section 82 is configured similarly to a conventional charging bucket used presently to charge smelting furnaces. Its exterior configuration comprises an outer cylindrical wall oriented in an upright manner. A suitable lid 85 covers the open end of the upper section 82. The section 82 is suitably supported by cables 84 connected to pivot pins 86 extending radially outwardly from the sides of the outer walls 88. The lower section 83 of the apparatus 80 is comprised of clam shell doors 90 and 92, which when closed from a bottom hemispherical closure for the upper charging bucket section 82. The doors 90 and 92 are hinged to the outer wall 88 of the upper section via a suitable hinge mechanism 94 located on opposite sides of the bucket section 82 at a location intermediate the upper and lower ends of the bucket section 82. Cables 96 and 98, attached to flanges on the clam shell door extremities, lead through an aperture on a flange 97 integral with the outer wall of the bucket section 84 above the hinge mechanism 94. The cables are attached to a suitable lifting ring 100 above the flange 97. By suitably manipulating cables 96 and 98, the clam shell door valves 90 and 92 can be swung outwardly and upwardly in mutually opposite directions about the hinge mechanism 94 to the location shown in dot-dash outline. In this manner, the bottom of the bucket section 82 is opened, allowing the contents of the bucket to be discharged when desired.

The structure heretofore described in basically the same for all conventional charging buckets. However the conventional structure has been modified in accordance with the present invention to include an inner wall 102 having a cyclindrical configuration mounted concentrically and within the outer wall 88. A fluid convection channel 104 is formed between the outer surface of the inner wall 102 and the inner surface of the outer wall 88. The inner wall 102 is secured in its inwardly spaced relationship to the outer wall 88 by suitable spacers 106 mounted between the walls. The upper circular edge of the cylindrical inner wall 102 terminates short of the lower surface of the lid 85 to provide a fluid connection between the upper portion of the charging bucket and the fluid channel 104. The cylindrical inner wall 102 extends downwardly to a location adjacent to and abutting the inner surface of the clam shell door halves 90 and 92 when closed, forming a chamber 108 within the inner wall 102. A plurality of slots 110 are located around the circumference of the clam shell halves 90 and 92 adjacent their periphery, placing the fluid channel 104 in fluid communication with the exterior of the clam shell door halves 90 and 92. Likewise, a plurality of apertures 112 are provided in the central portion of the clam shell door halves 90 and 92, placing the upper chamber 108 in fluid communication with the exterior of the clam shell door halves 90 and 92. With these modifications, the charging bucket 80 has been converted into a structure similar to the upper portion of the first embodiment described above.

The lower section 83 of this embodiment corresponds to the lower portion of the earlier described first embodiment. However, in this alternate embodiment, the lower section takes the form of a separate cylindrical, floor-mounted enclosure within which the hot ingots are housed and upon which the upper bucket section 82, charged with scrap metal, is lowered into functional engagement. The mating of the two sections forms a convectional heat transfer system which operates identically to the first embodiment. The lower section 83 comprises a first cylindrically shaped, outer wall 116 and a smaller diameter cylindrically shaped, inner wall 118 mounted concentrically and within the outer wall 116. The inner wall is suitably secured and held in its location relative to the outer wall by spacers 120. The space between the inner and outer walls forms a fluid convection channel 119. The diameter of the outer wall 116 corresponds substantially to the outer diameter of the upper charging bucket section 82 and the diameter of the inner wall 118 corresponds to the diameter of the inner wall 102 of the charging bucket 82. The lower section can be open on the bottom or can have a bottom wall 112, as illustrated, affixed to the lower edge of the cylindrical outer wall 116. The upper edge of the innner wall 118 in lower section 83 terminates below the upper edge of the outer wall 116 by a distance equal to the amount that the inner wall 102 of the upper bucket section 82 extends below the lower edge of the outer wall 88 plus the thickness of the clam shell doors. Thus, as the charging bucket 82 is lowered onto the lower section 83, the flange 114, provided on the periphery of the clam shell door halves 90 and 92, mates with the upper edge of the outer wall 116 while the upper edge of the inner wall 118 will mate with the outer surface of the clam shell door halves 90 and 92 immediately below the location of the bottom edges of the inner wall 102 of the upper section. The bottom edge of the inner wall 118 terminates at a location somewhat above the bottom wall 122 of the lower section 83 providing an aperture that places the convection channel in fluid communication with the interior of the lower section 83.

In operational use of this embodiment, ingots 124 are positioned in the lower section 83 in an upright or other suitable orientation. After the interior cavity 108 formed within the inner wall 102 of the charging bucket 82 has been filled with scrap metal, the bucket section 82 is lowered into mating engagement on top of the lower section 83. When so mated with the lower section, air entrapped within the apparatus is heated by the ingots, rises through the apertures 112 in the central portion of the clam shell doors, and contacts through the scrap metal residing in the inner chamber 108 of the charging bucket. The rising air transfers heat to the scrap metal and is subsequently cooled. The cooled air is then forced into and travels downwardly through the annular fluid channel 104 formed between the inner wall 102 and the outer wall 88 of the bucket 82. The relatively cool air descending through the fluid channel 104 exits from the bucket through the slots 110 in the periphery of the clam shell doors 90 and 92 and enters the fluid channel 119 between the inner and outer walls 118 and 116 of the lower section. Still descending, the cooled air re-enters the region occupied by the ingots 124 after exiting from the bottom portion of the annular fluid channel 119. After the scrap metal has been adequately preheated the charging bucket 82 is lifted by cables 84 and is emptied into a melting furnace by appropriate manipulation of the cables 96 and 98 which operate the clam shell doors. As explained, the alternate embodiment of FIG. 5 operates in a manner substantially identical to the first described embodiment of the apparatus.

The present invention has been described in relation to alternate embodiments. One of ordinary skill in the art after reading the foregoing specification will be able to effect several changes and substitutions of equivalents, and will be able to make other alterations without departing from the broad scope of the invention as set forth above. For example, the hot molds in which molten metal is formed into ingots can be used in conjunction with ingots or alone as the heat source in accordance with the present invention. It is therefore intended that the present invention be limited only by the definition contained in the appended claims.

What is claimed is:

1. A movable apparatus for preheating a material comprising:

a. housing means defining a substantially fluid tight receptacle having a top, b. a load-supporting member located within said housing means and so positioned therein as to divide said receptacle into a closed upper portion and a lower portion, said load-supporting member having apertures therein placing the lower portion of said receptacle in fluid communication with the upper portion of said receptacle along a first flow path, c. conduit means associated with said housing means and defining a fluid channel for placing the upper portion of said receptacle in fluid communication with the lower portion of said receptacle via a second flow path separate from said first flow path, said conduit means having an inlet positioned adjacent said top of said receptacle, said inlet placing said fluid channel in fluid communication with the upper portion of said receptacle, said conduit means extending from the upper portion of said receptacle to the lower portion of said receptacle, said conduit means having an outlet positioned in the lower portion of said receptacle, said outlet placing said fluid channel in fluid communication with the lower portion of said receptacle, d. door means associated with said housing means to allow access to the upper portion of said receptacle, 1. for charging the upper portion of said receptacle with a material to be heated, and, 2. for discharging a heated material from the upper portion of said receptacle, and, e. means associated with said housing means for gaining access to the lower portion of said receptacle for positioning a heated object therein.

2. The apparatus of claim 1 wherein said housing means includes a top wall, a bottom portion, and at least one sidewall, and wherein said conduit means comprises:

an inner wall having an upper end and a lower end, said inner wall extending downwardly from a location adjacent the top wall of said housing means to a location adjacent the bottom portion of said housing means, said inner wall being positioned inwardly from said sidewall so as to define an upright fluid convection channel between said sidewall and said inner wall, means defining an aperture associated with the upper end of said inner wall for placing said fluid convection channel in fluid communication with the upper portion of said receptacle, and means defining an aperture associated with the lower end of said inner wall for placing said fluid convection channel in fluid communication with the lower portion of said receptacle.

3. The apparatus of claim 2 wherein said means for gaining access to the lower portion of said receptacle comprises means defining an opening in the lower portion of said housing means, the apparatus further comprising:

a platform having an upper surface and means on the upper surface of said platform for supporting a heated object, said housing means having a bottom edge so constructed as to mate with the upper surface of said platform to support said housing means and to position said heated object within the lower portion of said receptacle, said heated object thereby being enclosed by said sidewall, at least a portion of said inner wall, said load-supporting member and said platform.

4. The apparatus of claim 1 wherein said housing means is separable into an upper section and a lower section at a location below and adjacent said load-supporting member, said housing including a bottom wall enclosing the bottom of said apparatus.

5. The apparatus of claim 2 wherein said inner wall has a layer of insulation affixed thereto to insulate said fluid channel from radiation and conduction from a heated object present in the lower portion of said receptacle.

6. The apparatus of claim 2 wherein said housing means comprises a pair of spaced sidewalls and a pair of spaced end walls forming a box-like enclosure with said top wall.

7. The apparatus of claim 2 wherein said sidewall is circular in cross section, said inner wall being circular in cross section and being spaced inwardly from said sidewall, and wherein said housing means is separable into an upper section and a lower section at a location below and adjacent said load-supporting member, said housing meaning further having a bottom wall enclosing the bottom of said apparatus.

8. An apparatus for preheating a material comprising:

a. housing means defining a receptacle having a top wall, a bottom portion and at least one sidewall, b. a load-supporting member located within said housing means and so positioned therein as to divide said receptacle into a closed upper portion and a lower portion, said load-supporting member having apertures therein placing the lower portion of said receptacle in fluid communication with the upper portion of said receptacle, c. an inner wall having an upper end and a lower end, said inner wall extending downwardly from a location adjacent the top wall of said housing means to a location adjacent the bottom portion of said housing means, said inner wall being positioned inwardly from said sidewall so as to define an upright fluid convection channel between said sidewall and said inner wall, means defining an aperture associated with the upper end of said inner wall for placing said fluid convection channel in fluid communication with the upper portion of said receptacle, and means defining an aperture associated with the lower end of said inner wall for placing said fluid convection channel in fluid communication with the lower portion of said receptacle, the upper end of said inner wall being positioned below said top wall, d. guard means for covering the upper end of said fluid channel, said guard means being fixed to said sidewall and extending longitudinally along said sidewall and extending inwardly from said sidewall over the edge of said inner wall, thereby forming a protective cover over said fluid channel defined between said inner wall and said sidewall, said guard means being spaced inwardly from the upper edge of said inner wall to form said aperture associated with the upper end of said inner wall, e. door means associated with said housing means to allow access to the upper portion of said receptacle, 1. for charging the upper portion of said receptacle with a material to be heated, and, 2. for discharging a heated material from the upper portion of said receptacle, and, f. means associated with said housing means for gaining access to the lower portion of said receptacle for positioning a heated object therein.

9. A method for preheating scrap metal comprising:

a. positioning a heated metal ingot on a platform, b. supporting a charge of scrap metal above said ingot so that said charge is in fluid communication with the region surrounding said ingot, c. enclosing said charge of scrap metal and said ingot to form a substantially fluid-tight chamber so that the air in the region surrounding said ingot is heated and directed upwardly through said charge of scrap metal, said air transferring heat to said charge of scrap metal as it passes therethrough, and d. returning the air that has passed through the charge of scrap metal by convection from the region adjacent the top of said charge to the region surrounding said ingot through a fluid channel separate from the region enclosing said ingot and said charge.

10. The method of claim 9 wherein said ingot is positioned above the upper surface of said platform, thereby leaving a space between said ingot and the upper surface of said platform.

11. A method for preheating scrap metal comprising:

a. positioning a heated metal ingot on a platform, b. supporting a charge of scrap metal above said ingot so that said charge is in fluid communication with the region surrounding said ingot, said charge of scrap metal including scrap metal at least partially coated with a combustible material, c. enclosing said charge of scrap metal and said ingot to form a substantially fluid-tight chamber so that the air in the region surrounding said ingot is heated by said metal ingot and directed upwardly through said charge of scrap metal, said air transferring heat to said charge of scrap metal as it passes therethrough, said heated metal ingot being sufficiently hot to raise the temperature of the charge of scrap metal to the kindling temperature of said combustible material, at least a portion of the heat produced by the combustion of said combustible material being transferred to said scrap metal, and d. returning the air that has passed through said scrap metal by convection from the region adjacent the top of said charge of scrap metal to the region surrounding said ingot through a fluid channel separate from the region enclosing said ingot and said charge.

12. The method of claim 11 wherein said combustible material comprises oil coated on said scrap metal when said scrap metal is being produced.

* * * * *